US005454514A

United States Patent [19]

Pollock et al.

[11] Patent Number: 5,454,514

[45] Date of Patent: Oct. 3, 1995

[54] RAIL ANCHOR ASSEMBLY

[76] Inventors: Mark A. Pollock, 12113 S. Tab Rd., Solon Springs, Wis. 54873; Duane B. Christiansen, 107 E. County Rd. "C", Superior, Wis. 54880; Dale J. Mertes, 7299 E. State Rd. 13, South Range, Wis. 54874; James A. Remington, 1414 E. 3rd St., Superior, Wis. 54880

[21] Appl. No.: 279,556

[22] Filed: Jul. 25, 1994

[51] Int. Cl.[6] ..... E01B 9/00

[52] U.S. Cl. ..... 238/311

[58] Field of Search ..... 238/311, 315, 238/338, 343, 344, 349, 351, 352, 353, 354

[56] References Cited

U.S. PATENT DOCUMENTS

| | | | |
|---|---|---|---|
| 2,426,137 | 8/1947 | Asselin | 238/338 |
| 4,193,544 | 3/1980 | Marchant et al. | 238/338 |
| 4,824,015 | 4/1989 | Farrell et al. | 239/349 |

FOREIGN PATENT DOCUMENTS

| | | | |
|---|---|---|---|
| 3833265 | 10/1989 | Germany | 238/351 |

*Primary Examiner*—Mark T. Le
*Attorney, Agent, or Firm*—Thomas S. Baker, Jr.

[57] ABSTRACT

A rail anchor assembly is provided with particularly-configured shoulder fittings welded to a base plate component in a manner which eliminates the necessity of weld grinding in order to assure non-interference between the shoulder fitting rail abutment end weld and a cooperating rail positioned upon the base plate component in proximity to the weld. The shoulder fitting rail abutment end includes an undercut which extends with increasing depth from the shoulder fitting rail abutment end vertical rail abutment face toward the rail retainer spring clip opening portion of the shoulder fitting to thereby form one side of a weld bevel groove accessible from within the shoulder fitting spring clip opening portion.

2 Claims, 1 Drawing Sheet

RAIL ANCHOR ASSEMBLY

This invention relates to railway surface track systems generally, and particularly concerns an improved shoulder fitting for a rail anchor assembly which may be manufactured and utilized advantageously for fastening a rail or rails to a railroad tie member or other suitable rail base.

BACKGROUND OF THE INVENTION

One well-known form of rail anchor assembly is comprised of a metal base plate that later is secured to a wood railroad tie member by multiple bolts or spikes, a pair of generally curved shoulder fittings secured to the metal base plate by welds and spaced apart by a distance which is just slightly greater than the width of the base of the rail that is to be anchored by the assembly, and a pair of spring clips which cooperate with the shoulder fittings and with the base of the rail to fasten and additionally restrain the rail from movement relative to the base plate and its railroad tie support.

In the manufacture of the known rail anchor assembly it has been a common practice to weld each shoulder fitting to the base plate with weld beads positioned at both the shoulder fitting outer end and shoulder fitting rail end, which ends each contact the base plate, and to afterwards grind or machine away that portion of each shoulder fitting rail end weld bead which otherwise would interfere with placement of the track rail on the base plate in the gap between adjacent shoulder fittings. The prior art rail anchor assembly so-manufactured also, in instances wherein it later becomes necessary to replace a shoulder fitting that has become missing during the course of railway operations with another shoulder fitting, requires that the base plate be removed from the rail tie and rail, that a replacement shoulder fitting be welded in its proper position on the base plate, and that again a portion of the replacement shoulder fitting rail end weld bead be ground or machined away to eliminate the otherwise present rail-to-weld bead interference.

We have discovered that the necessity of weld bead removal can be eliminated as to both original manufacture and replacement installation operations by use of an advantageous design feature for the assembly shoulder fitting component of the improved rail anchor.

SUMMARY OF THE INVENTION

Our invention is basically comprised of a metal base plate component and a pair of particularly-formed and particularly spaced-apart metal shoulder fitting components with each such shoulder fitting component being welded to the base plate component in a specified manner. Each shoulder fitting component is unitarily formed to have, in transverse section, a shoulder fitting rail abutment end portion, a shoulder fitting outer end portion, and a clip retainer portion intermediate the fitting outer and rail abutment end portions. The clip retainer portion is generally arcuate in cross-sectional configuration and, together with the upper surface of the base plate to which the shoulder fitting is welded, functions to form an opening that receives and retains one leg of a conventional cooperating spring clip rail retainer.

The rail abutment end portion of the shoulder fitting is undercut, as is the fitting outer end portion, so as to form a weld bevel groove when placed on the base plate component. In the case of the shoulder fitting rail abutment end portion undercut, it is important that such be oriented to be accessible for being welded from regions inside the opening formed by the fitting clip retainer portion where no part of the weld bead so-formed need be removed by grinding before any subsequent placement of a rail in the rail anchor assembly. Also, in the case of welding a replacement shoulder fitting to the base plate component, welding may be accomplished without base plate removal because the shoulder fitting rail abutment end weld groove is accessible from within the fitting arcuate clip retainer portion interior, and the presence of the cooperating rail will not interfere with the required welding.

Additional advantages associated with our invention may become apparent from a careful consideration of the drawings and detailed description which follow.

DETAILED DESCRIPTION

Figure 1:
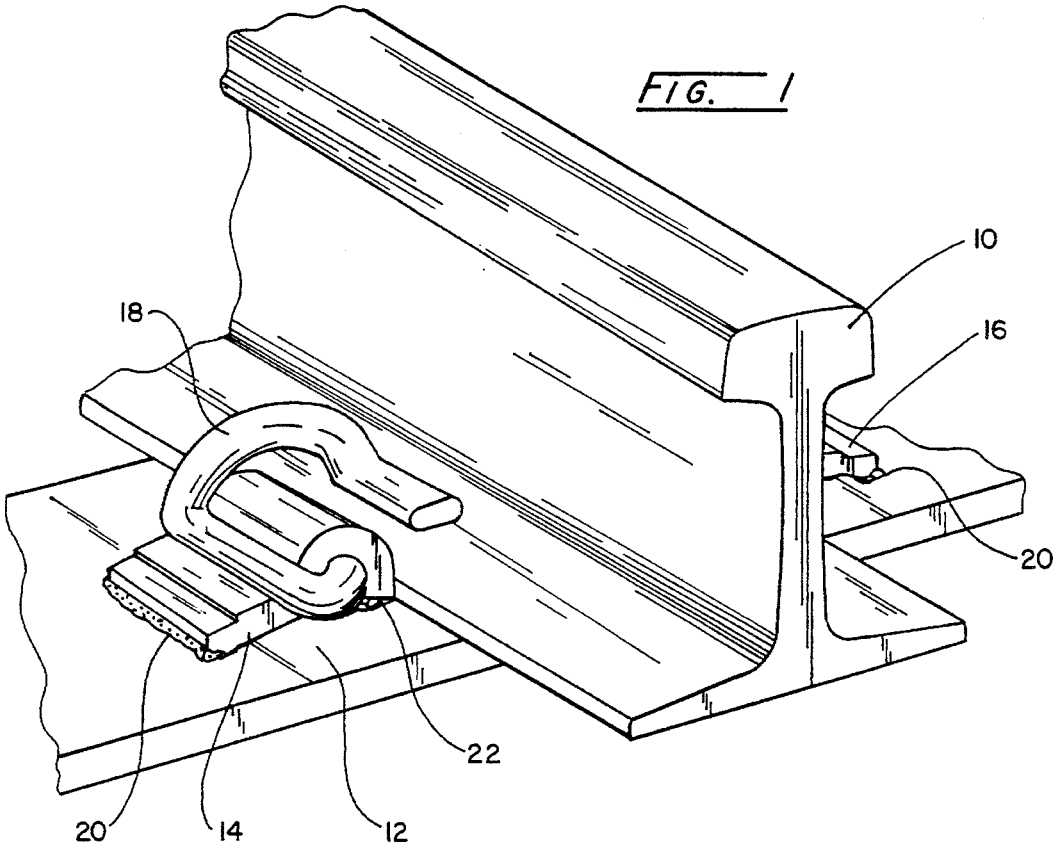
FIG. 1 is a perspective view of a portion of a railway track system rail installation which includes the improved rail anchor assembly of this invention.

FIG. 1 illustrates a portion of a railway system steel rail (10) which is supported by steel base plate (12) and restrained in its supported position by a spaced-apart pair of shoulder fittings (14 and 16) which are welded to base plate (12) and by a pair of conventional spring clips of which only one (spring clip 18) appears in the illustration. Each shoulder fitting (14 and 16) is welded to base plate (12) by an outer end weld bead (20) and by a rail end weld bead (22). Although not illustrated in FIG. 1, base plate (12) is provided with multiple openings for the insertion of conventional fasteners such as bolts or spikes used to secure the base plate to a conventional support such as a rail tie (also not shown).

Figure 3:
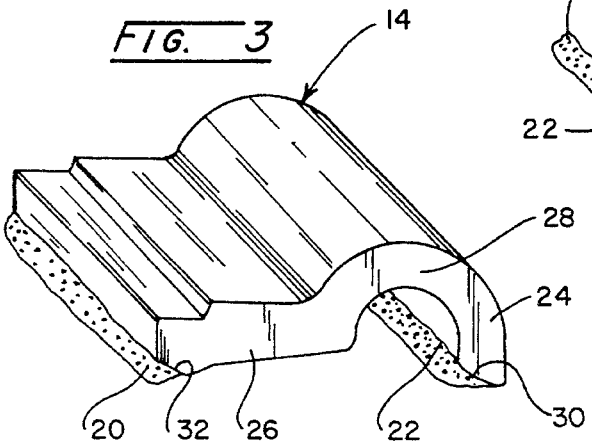
FIG. 3 is a perspective view of the welded shoulder fitting component of the rail anchor assembly of FIG. 1.
Figure 2:
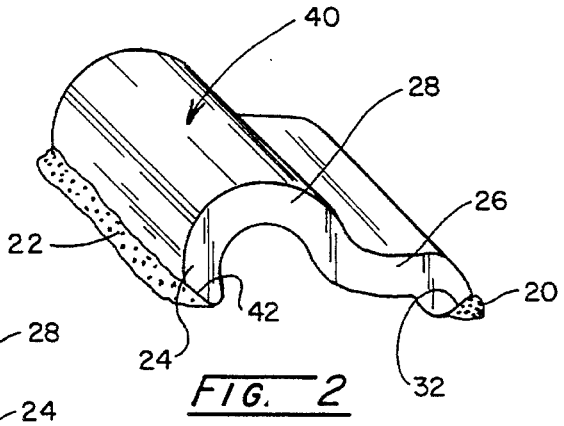
FIG. 2 PRIOR ART
FIG. 2 is a perspective view of a welded prior art rail anchor assembly shoulder fitting component.

As shown in FIG. 3, shoulder fitting (14) has a rail abutment end portion (24), an outer end portion (26), and a clip retainer portion (28) which extends intermediate the fitting end portions. In the FIG. 1 arrangement, shoulder fittings (14 and 16) are spaced apart a distance whereby their respective rail end exterior vertical faces will be very nearly in abutting relation to the edges of the base of rail (10). Thus, it is important that the undercut (30) provided in the shoulder fitting rail abutment end portion (24) be oriented so that the bevel groove for welding which it forms with the upper surface of base plate (12) when placed in position is accessible for weld formation from the interior region of arcuate clip retainer portion (28) rather than from the fitting exterior closest to the position of the rail base edge. Note that in the FIG. 2 prior art shoulder fitting referenced as 40, the rail end portion undercut (42) is oriented in a opposite sense relative to the fitting vertical rail abutment face. (Note also that the undercut (32) provided for forming a weld bead groove at the shoulder fitting outer end portion (26) is oriented in the same direction in each of the FIG. 2 and the FIGS. 1 and 3 shoulder fitting versions). In the prior art method of weld bead location it becomes necessary to grind or machine away that portion of the weld bead that projects exteriorly beyond the fitting rail end portion vertical rail abutment face to permit proper seating of the rail upon the rail anchor assembly base plate. No portion of a weld (20) requires removal because that weld is positioned distant from the base of rail (10).

Lastly, it should be pointed out that spring clip (18) utilized with the improved rail anchor assembly comprises no part of the present invention and such may take any of several different forms. The form illustrated in FIG. 1 corresponds to the configuration of a spring clip presently marketed in the United States by Pandrol Jackson, Inc. of Ludington, Mich. It is essentially only necessary that the spring clip-receiving opening formed by the upper surface of base plate (12) and the interior surface of welded shoulder fitting clip retainer portion (28) have a cross-sectional configuration suitable for receiving the cooperating leg of the spring clip selected to be driven into the opening for the purpose of limiting vertical movement of the rail base with which it cooperates.

Component part shapes, relative sizes, and materials other than those disclosed in the drawings and detailed description may be utilized in the practice of our invention without departing from the scope or intent of the claims which follow.

We claim as our invention:

1. A rail anchor assembly comprising:

a metal plate having an upper surface;

a pair of spaced-apart metal shoulder fittings each having a shoulder fitting outer end portion, a shoulder fitting rail abutment end portion, and a shoulder fitting spring clip opening portion joining said outer end portion to said rail abutment end portion;

said shoulder fitting spring clip opening portion cooperating with said face plate upper surface to define an opening for receiving a rail retainer spring clip; and wherein said shoulder fitting rail abutment end portion having an essentially vertical exterior rail abutment face and an undercut which extends from said exterior rail abutment face with increasing dimension towards said shoulder fitting spring clip opening portion to thereby form one side of a weld bevel groove accessible from within said shoulder fitting spring clip opening portion;

a first pair of welds which join each one of said pair of shoulder fittings outer end portions to said base plate; and a second pair of welds which each engage one of said weld bevel grooves to join one of said pair of shoulder fitting rail abutment end portions to said base plate.

2. A rail anchor assembly metal shoulder fitting comprising, in combination:

a shoulder fitting outer end portion;

a shoulder fitting rail abutment end portion; and a shoulder fitting spring clip opening portion joining said outer end portion to said rail abutment end portion, said shoulder fitting rail abutment end portion having an essentially vertical exterior rail abutment face, and having an undercut which extends from said exterior rail abutment face with increasing dimension towards shoulder fitting spring clip opening portion to thereby form one side of a weld bevel groove accessible from within said shoulder fitting spring clip opening portion.

* * * * *